US006409584B1

(12) United States Patent
Lin

(10) Patent No.: US 6,409,584 B1
(45) Date of Patent: Jun. 25, 2002

(54) SPEED ADJUSTING DEVICE FOR PNEUMATIC GRINDING TOOL

(75) Inventor: Freddy Lin, Taichung (TW)

(73) Assignee: Gison Machinery Co., Ltd. (TW)

( * ) Notice: Subject to any disclaimer, the term of this patent is extended or adjusted under 35 U.S.C. 154(b) by 0 days.

(21) Appl. No.: 09/910,861

(22) Filed: Jul. 24, 2001

(51) Int. Cl.[7] ..... B24B 55/00

(52) U.S. Cl. ..... 451/295; 451/359

(58) Field of Search ..... 451/295, 344, 451/358, 359; 137/535, 540; 415/30, 904

(56) References Cited

U.S. PATENT DOCUMENTS 3,930,764 A * 1/1976 Curtiss ..... 418/43
4,729,436 A * 3/1988 Amador et al. ..... 415/25

FOREIGN PATENT DOCUMENTS

SU 0779036 * 11/1980 ..... 451/295

* cited by examiner

*Primary Examiner*—Robert A. Rose
(74) *Attorney, Agent, or Firm*—Troxell Law Office PLLC

(57) ABSTRACT

A speed adjusting device for a pneumatic grinding tool includes an axle having a passage defined longitudinally therein and a plurality of apertures are defined in an outer periphery of the axle. A base is mounted and rotated with the axle. A plurality of slide members are respectively and movably received in the slide paths in the base. A disk has a flange extending from a periphery of a front side of the body and a neck extends from a rear side of the body. A plurality of air holes are defined through the neck. The disk is movably mounted on the axle and rotated with the axle. The flange covers the outside of the base. The air holes are located in alignment with the apertures when in normal condition. The air holes are located off alignment with the apertures when the disk is pushed backward by the slide members affected by centrifugal force.

5 Claims, 6 Drawing Sheets

SPEED ADJUSTING DEVICE FOR PNEUMATIC GRINDING TOOL

FIELD OF THE INVENTION

The present invention relates to a pneumatic tool and more particularly, to a speed adjusting device of a pneumatic grinder and which stabilizes the rotational speed of the grinder and makes sure that the speed will not be fluctuated by changes of the pressure, and the speed adjusting device will not malfunctioned

BACKGROUND OF THE INVENTION

A conventional pneumatic grinding tool such as grinders or polishers is designated by reference 10 in FIG. 1. A rotator 14 is installed in a cylinder 13 in a casing 12 and the rotator 14 has a grinding plate 16 on the axle 15 thereof. A speed adjusting device 20 is installed in the chamber 17 in the casing 12 and the speed adjusting device 20 is co-rotated with the rotator 14. After the high pressure air is introduced in the pneumatic tool, the air pressure enters in the chamber 17 via an inlet 18 and then enters in the cylinder 13 via several holes 19 to drive the rotator 14. By the rotation of the rotator 14 to grind objects by the grinding plate 16.

Due to many factors affect the air pressure so that the air pressure for the pneumatic tool is not constant. When the air pressure raised, the rotational speed of the rotator 14 increases. On the contrary, the speed reduces when the air pressure drops. Because the grinding plate 16 has a pre-determined speed limit, it could be broken when the speed is higher than the pre-determined speed limit. Therefore, a speed adjusting device 20 is required to prevent the situation mentioned above.

As shown in FIGS. 2, 3 and 4, a conventional speed adjusting device 20 has an axle 22 and an adjusting rod 24 which is a straight rod and fixed to the axle 22 and rotatable with the axle 22. A stop 26 is slidably mounted to an end of the adjusting rod 24. The stop 26 is biased by a spring 27. Two adjusting members 28 are respectively engaged with the recesses 241 in two ends of the adjusting rod 24. Each adjusting member 28 has a tip end 281 at its pivot able end. The axle 22 is fixed to the rotator 14 at its front end and is rotatable with the rotator. The stop 26 is located in front of the inlet 18 as shown in FIG. 1.

When the rotator 14 is not rotated, the stop 26 is pushed by the spring 27 and maintained to slide forward, and the two adjusting members 28 are not open outward as shown in FIG. 2. When the rotator 14 is rotated, the speed adjusting device 20 is rotated and the two adjusting members 28 are moved outward because of the centrifugal force as shown in FIG. 4. The stop 26 is pushed backward by the tip end 281 of the speed adjusting members 28 so that the distance between the stop 26 and the inlet 18 is changed. The outward movements of the two adjusting members 28 are increased when the air pressure and the speed of the rotator 14 are high. This will move the stop 26 toward the inlet 18 to reduce the volume of the air coming in to prevent the rotator 14 from over-speed.

There are some inherent shortcomings:

1. As shown in FIG. 3, the speed adjusting device 20 is an elongated shape so that there are cut points "b" on the outside of the two longitudinal sides "A". The cut points "b" generate turbulent air flow and make the speed adjusting device to be in an idle status which makes the tool shaking.
2. In the situation in FIG. 4, the tip end 281 of the adjusting members 28 pushes the stop 26 due to the centrifugal force, and the direction of the stop 26 is parallel with the direction of the air flow. The inlet air directly affects the stop 26 so that the adjusting members 28 bear the inlet pressure. The tip end 281 is then worn out and becomes too short to move the stop 26 such that the function of adjusting the speed of the rotator 14 is loosened. The adjusting members 28 may also shift abnormally as shown in FIG. 5 and jammed with the stop 26. This could mis-function the tool.
3. The adjusting rod 24 is a long rod and the two recesses 241 on two ends of the rod 24 makes the adjusting rod 24 to be a hollow rod which tends to be deformed when the rod is proceeded with heat treatment. The two ends of the rod are symmetrically deformed and result shaking when the rod is rotated. Similarly, the stop 26 is a thin member which is deformed after being heat-treated so that the stop 26 could have interference friction with the axle 22.
4. The speed adjusting device 20 bears the air pressure directly so that the parts of the device tend to be worn out by the air pressure.
5. Because the stop 26 is affected by the high pressure air flow, it is difficult to move back when the pressure increased and the adjusting member 28 are difficult to open outward. When the inlet pressure is higher than 90 psi as shown in FIG. 6, the function of the speed adjusting device reduced and the speed of the rotator increases so that the conventional speed adjusting device cannot control the speed of the rotator.

SUMMARY OF THE INVENTION

The primary object of the present invention is to provide a speed adjusting device for a pneumatic grinding tool and which effectively controls the speed of the rotator of the pneumatic grinding tool.

Another object of the present invention provides a speed adjusting device for a pneumatic grinding tool wherein the pressure that the speed adjusting device bears can be reduced.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 7:
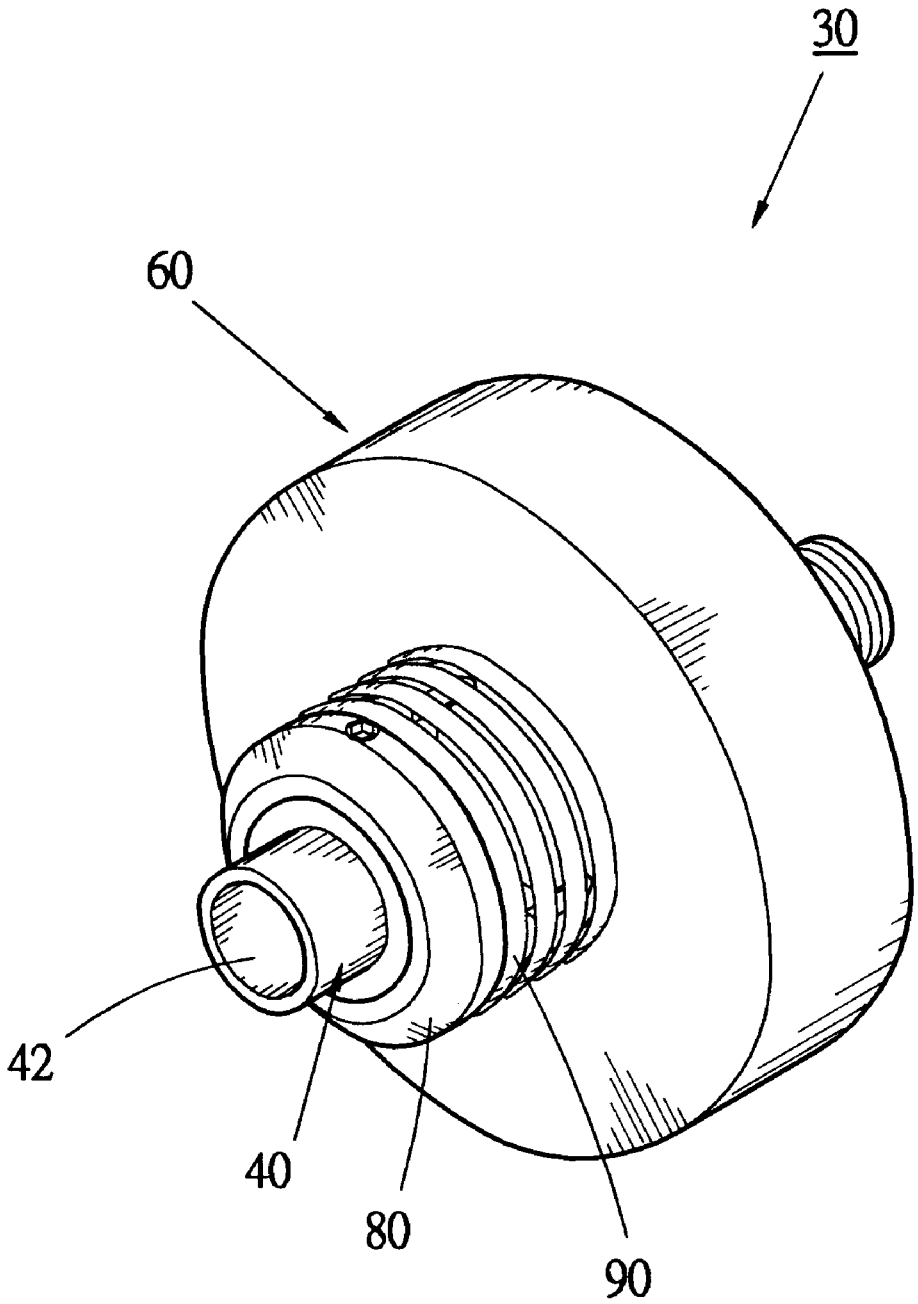
FIG. 7 is a perspective rear view to show the preferred embodiment of the present invention.
Figure 8:
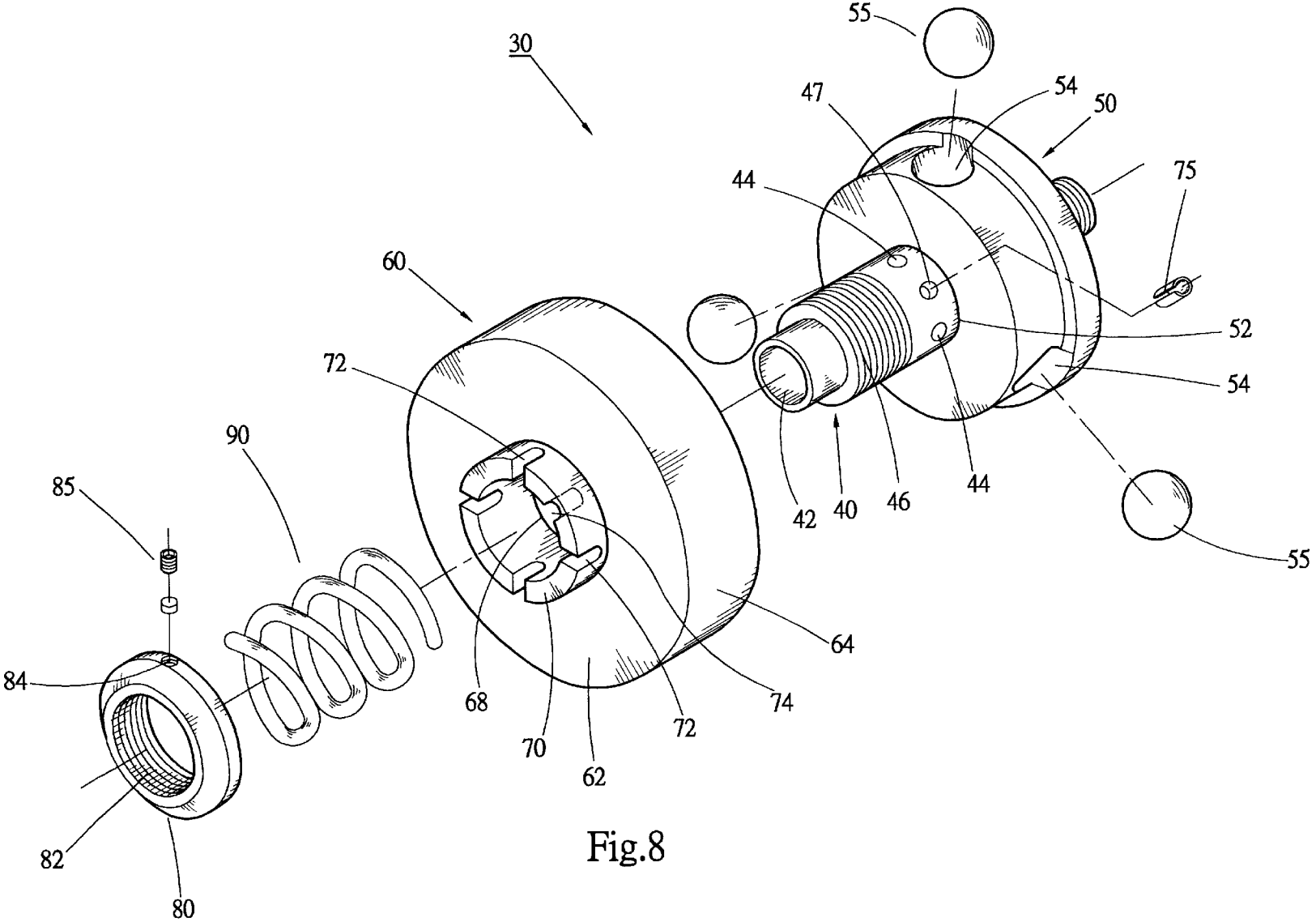
FIG. 8 is an exploded view to show the device shown in FIG. 7.
Figure 9:
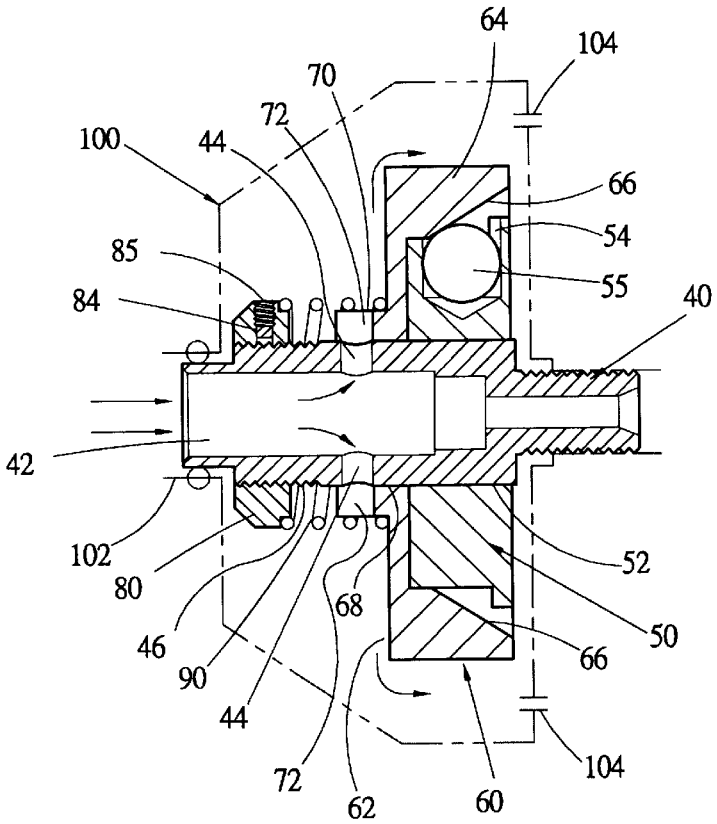
FIG. 9 is a cross sectional view to show the device shown in FIG. 7.

Referring to FIGS. 7 and 8, the speed adjusting device 30 for a pneumatic grinder of the present invention comprises:

An axle 40 which has a passage 42 defined longitudinally in a rear end of the axle 40 and the passage 42 stops before the front end of the axle 40. Four apertures 44 arranged as a circle at equal intervals are defined in an outer periphery of the axle 40 and communicate with the passage 42 as shown in FIG. 9.

A base 50 is a circular member and mounted to the axle 40 by its hole 52 so as to be rotated with the axle 40. The base 50 is located in front of the apertures 44. Three slide paths 54 are located in the periphery of the base 50 at equal intervals 4 and are recessed inward.

Three slide members 55 which are beads and respectively movable and received in the slide paths 54.

A disk 60 has a circular body 62 and a flange 64 extending from a front side of the periphery of the body 62. The flange 64 has an inclined cone-shaped surface 66 in its inner surface as shown in FIG. 9. A mount hole 68 is defined through a center of the body 62. A neck 70 extends from the rear side of the body 62 along a periphery of the mount hole 68 and four air holes 72 are defined through the neck 70 at equal intervals. The disk 60 is mounted on the axle 40 from the rear end of the axle by said mount hole 68 and is movable on the axle, and the flange 64 covers the outside of the base 50. The slide members 55 could contact the coneshaped surface 66 of the flange 64. The four air holes 72 are located in alignment with the four apertures 44 as shown in FIG. 9. A position pin 75 has one end thereof inserted in the pin hole 47 in the axle 40, and the other end of the pin 75 is engaged with the notch 74 defined in the inside of the neck 70. Therefore, the disk 60 is co-rotated with the axle 40 and movable on the axle 40.

An adjusting member 80 which is a nut and is mounted to the threaded portion 46 on the rear end of the axle 40 by its threaded hole 82. A screw 85 is threaded to the radial hole 84 of the adjusting member 80 and contacts against the axle 40 as shown in FIG. 9, so as to position the adjusting member.

A spring 90 is mounted to the axle 40 and two ends of the spring 90 respectively contact the adjusting member 80 and the disk 60. When the disk is not applied by a force, it is maintained to slide forward and contacts the base 50.

As shown in FIG. 9, the speed adjusting device 30 is installed in the chamber 100 of the grinder and the front end 48 of the axle 40 is fixed to the rotator and co-rotated with the rotator. The passage 42 in the rear end of the axle faces the high pressure air inlet 102. The force of the spring 90 pushed on the disk 60 is adjusted by adjusting the position of the adjusting member 80 on the axle. Under normal condition, the disk 60 is positioned by contacting the base 50 and the four air holes 72 are located in alignment with the four apertures 44.

When the high pressure is introduced in the inlet 102 of the grinder, the high pressure enters in the passage 42 in the axle 40 and then enters the chamber 100 via the air holes 72 and the apertures 44, and then drives the rotator via the hole 104, the speed adjusting device 30 is rotated too. When the rotational speed of the rotator is in a normal range and the inlet pressure is in a normal range, the centrifugal force of the slide members 55 cannot overcome the spring force of the spring 90 so that the disk 60 is not moved. The four air holes 72 communicate with the four apertures 44 and will not affect the air flow.

Figure 10:
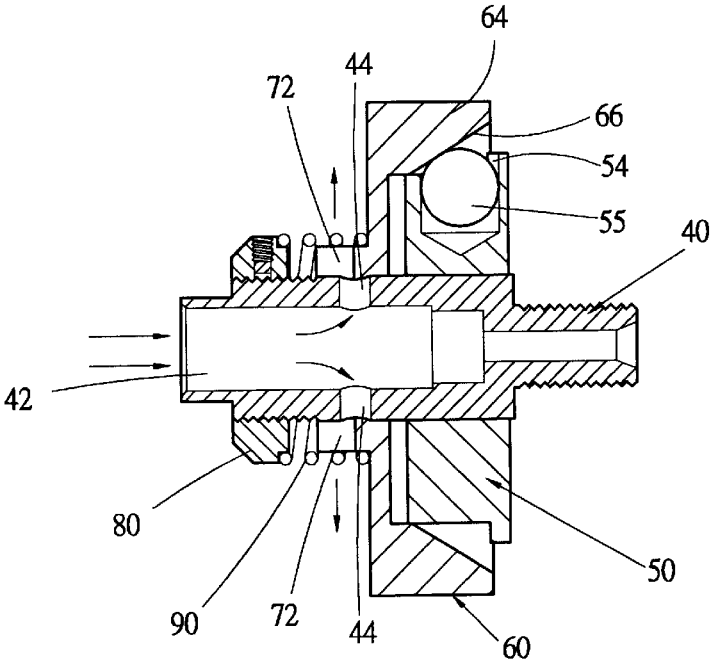
FIG. 10 is similar to FIG. 9 and shows the operational status.

When the pressure increases and the speed of the rotator increases, the slide members 55 moves outward along the slide path 54 and the centrifugal force applies on the cone-shaped surface 66 of the disk 60 and pushes disk 60 backward. The force of the movement of the disk is larger than the spring force so that the disk 60 is moved as shown in FIG. 10 and the four air holes 72 are off alignment with the four apertures 44 so as to reduce the air flow via the four air holes 72 and the four apertures 44. Therefore, the speed of the rotator is reduced to avoid from over-speed.

Till the air pressure drops to the normal range, the centrifugal force applied to the slide members 55 is not large to push the disk 60 which is then pushed back to its normal position by the spring 90 as shown in FIG. 9. The adjustment of the spring force applied to the adjusting members 80 can change the timing of the movement of the disk 60.

Figure 1:
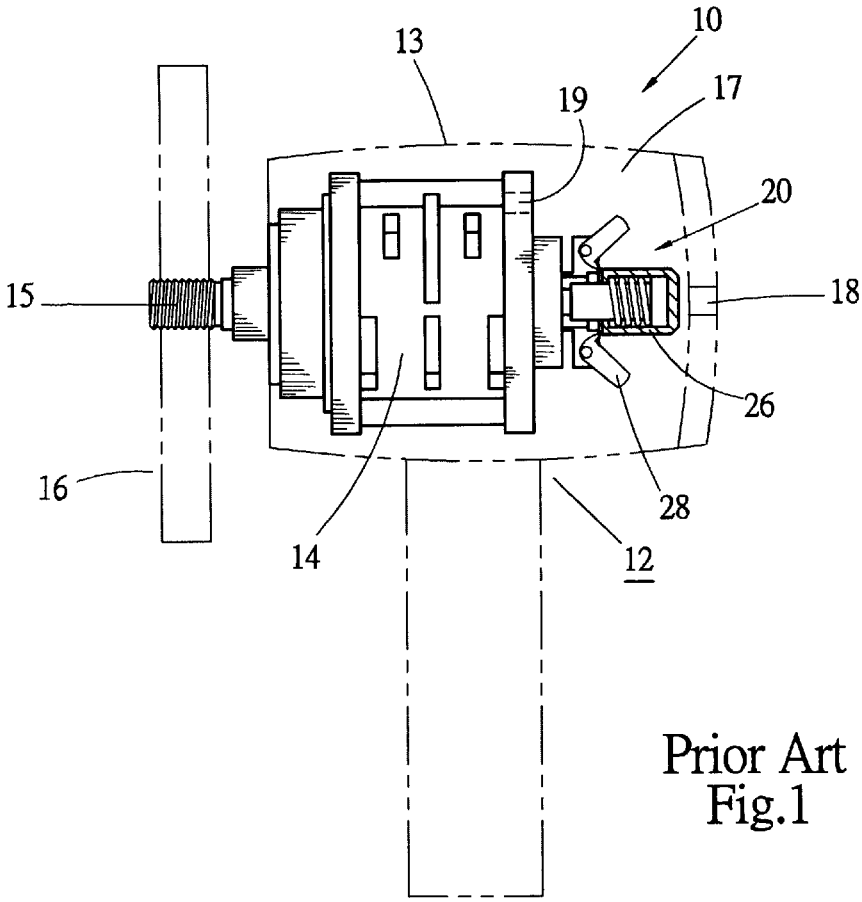
Prior Art Fig.1
FIG. 1 is an illustrative view to show a pneumatic grinder.
Figure 2:
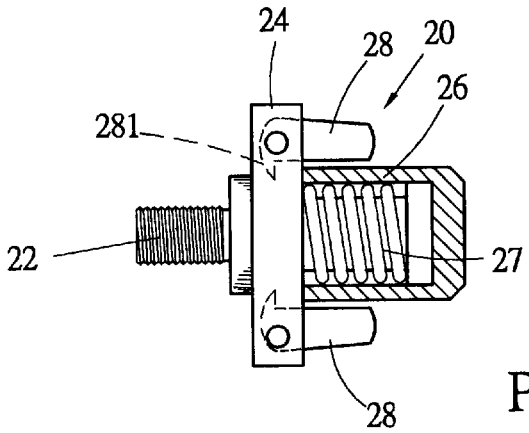
Prior Art Fig.2
FIG. 2 is a front view to show a conventional speed adjusting device.
Figure 3:
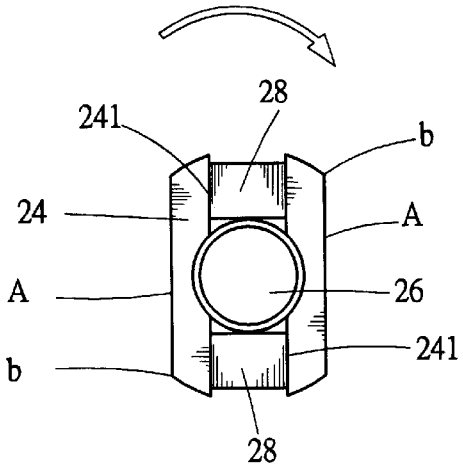
Prior Art Fig.3
FIG. 3 is a right side view of the device shown in FIG. 2.
Figure 4:
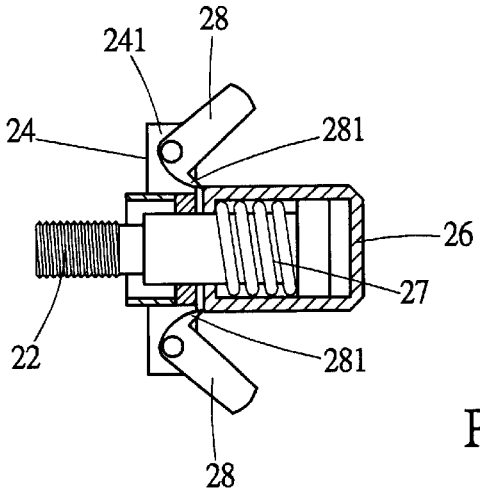
Prior Art Fig.4
FIG. 4 shows the device shown in FIG. 2 is operated.
Figure 5:
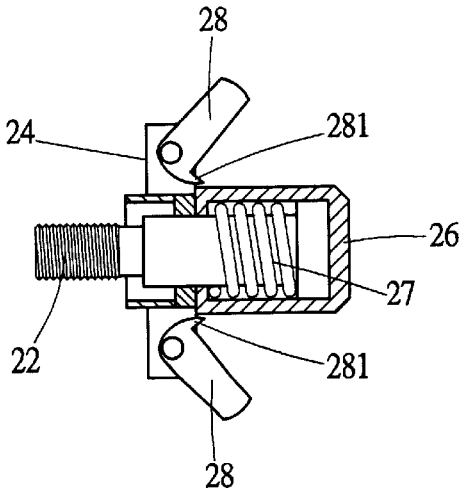
Prior Art Fig.5
FIG. 5 shows that the device shown in FIG. 2 is mis-functioned.
Figure 6:
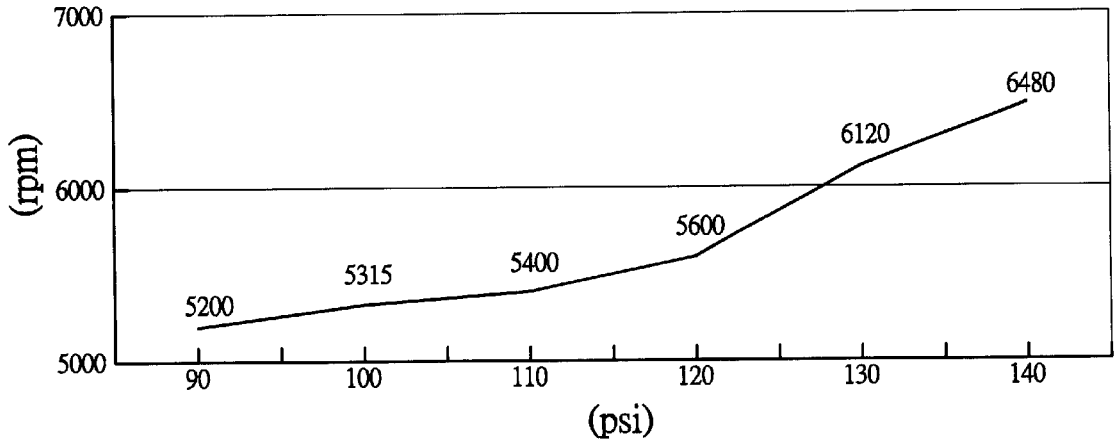
Prior Art Fig.6
FIG. 6 is a chart showing the speed of the conventional pneumatic grinder and the air pressure.
Figure 11:
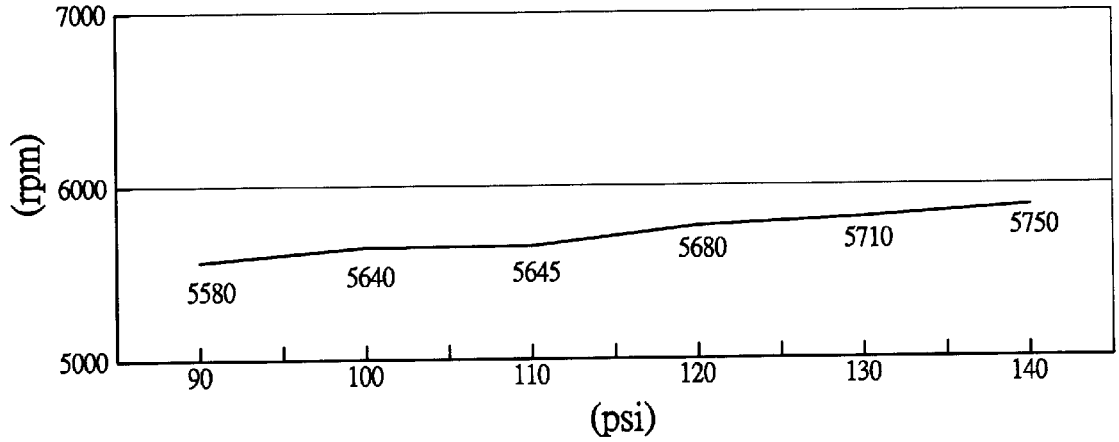
FIG. 11 is a chart showing the speed of the conventional pneumatic grinder and the air pressure of the device of the present invention.

The features of the present invention are:

1. The present invention is a circular rotational member so that the air flow will not affect its rotation. As shown in FIG. 9, the pressurized air flows in the chamber along the outer periphery of the disk so that the speed adjusting device will not interfere the air flow. Accordingly, the present invention will not result in idle or air resistance and the tool will not shake.
2. The air flow is controlled by the alignment of the air holes and the apertures. This is an effective and reasonable way so that the tool will not be misfunctioned.
3. The parts of the present invention are circular and will not be deformed after being heat-treated so that they maintain the precise shapes and increase the smoothness of the operation.
4. The high pressure air enters in the passage of the axle directly and enters in the chamber via the air holes and apertures, so that the speed adjusting device bears less pressure. The air flow is blocked perpendicularly by the off alignment of the air holes and apertures so that the parts are not affected by the high pressure and therefore the wear of parts is reduced.
5. Because the present invention is not affected by the air pressure, and has no air resistance and no turbulence, the operation is smooth and precise. The applicant use the product of the present invention to take a test which is shown in FIG. 11, even if the air pressure changes dramatically, the rotational speed of the rotator is still in stable.

What is claimed is:

1. A speed adjusting device for a pneumatic grinding tool, comprising:

an axle having a passage defined longitudinally in a rear end thereof and a plurality of apertures defined in an outer periphery of the axle at equal intervals, said apertures communicating with said passage, a front end of said axle connected to a rotator;

a base being a circular member and mounted to said axle and rotated with said axle, said base located in front of said apertures, a plurality of paths located in a periphery of said base at equal intervals;

a plurality of slide members respectively and movably received in said slide paths;

a disk having a circular body and a flange extending from a periphery of a front side of said body, said flange having an inclined cone-shaped surface defined in an inner surface thereof, a mount hole defined through a center of said body, a neck extending from a rear side of said body along a periphery of said mount hole, a plurality of air holes defined through said neck at equal intervals, said disk movably mounted on the axle by said mount hole and rotated with said axle, the flange covering the outside of the base, said slide members could contact said cone-shaped surface of said flange, said air holes located in alignment with said apertures;

a spring pushing said disk which is maintained to slide forward and positioned at a normal position;

whereby said air holes located in alignment with said apertures when in normal condition; said air holes located off alignment with said apertures when a rotational speed of said rotator is over speed and the disk is pushed backward by the slide members affected by centrifugal force.

2. The device as claimed in claim 1 further comprising an adjusting member movably mounted to said axle and located at a rear end of said disk, two ends of said spring respectively contacting said adjusting member and said disk.

3. The device as claimed in claim 2 wherein said axle has a threaded portion defined in a rear end thereof and said adjusting member is a nut which is threadedly engaged with said threaded portion.

4. The device as claimed in claim 1 wherein said neck of said disk has a notch defined in an inside of said neck, a position pin having one end thereof inserted in a periphery of said axle and the other end of said pin engaged with said notch.

5. The device as claimed in claim 1 wherein said disk is positioned by contacting said base when in normal condition.

* * * * *